United States Patent [19]

Scourtes

[11] 3,991,530

[45] Nov. 16, 1976

[54] SWIMMING POOL CONSTRUCTION

[76] Inventor: Chris N. Scourtes, 28875 Joy Road, Westland, Mich. 48185

[22] Filed: Aug. 15, 1975

[21] Appl. No.: 604,887

[52] U.S. Cl. ..... 52/146; 4/172.19; 52/169 R

[51] Int. Cl.[2] ..... E04H 12/20

[58] Field of Search ..... 52/169, 146; 4/172.19

[56] References Cited

UNITED STATES PATENTS

| | | | |
|---|---|---|---|
| 3,335,430 | 8/1967 | Schwarz et al. | 52/169 X |
| 3,371,455 | 3/1968 | Fox | 52/169 |
| 3,675,253 | 7/1972 | Danzker | 4/172.19 |
| 3,906,688 | 9/1975 | Witte | 52/169 X |
| R26,977 | 11/1970 | Perevia | 52/169 X |

FOREIGN PATENTS OR APPLICATIONS

| | | | |
|---|---|---|---|
| 807,351 | 3/1969 | Canada | 4/172.19 |
| 1,544,932 | 9/1968 | France | 52/169 |

*Primary Examiner*—Alfred C. Perham
*Attorney, Agent, or Firm*—Cullen, Settle, Sloman & Cantor

[57] ABSTRACT

A below ground swimming pool formed of light-weight framed, wood sheet walls arranged within a preformed pool shaped hole, with a water impervious, thin plastic sheet liner covering the inside surfaces of the walls and the ground enclosed by the walls, and with the walls being held against collapsing inwardly, upon draining of the pool, by braces secured to the outer or ground side of the walls. The braces are formed with horizontally extending legs located at the lower edges of the walls so that such legs are weighted by the ground to maintain the braces and walls in position and so that such legs also function as support footings for the walls.

3 Claims, 9 Drawing Figures

FIG. 5
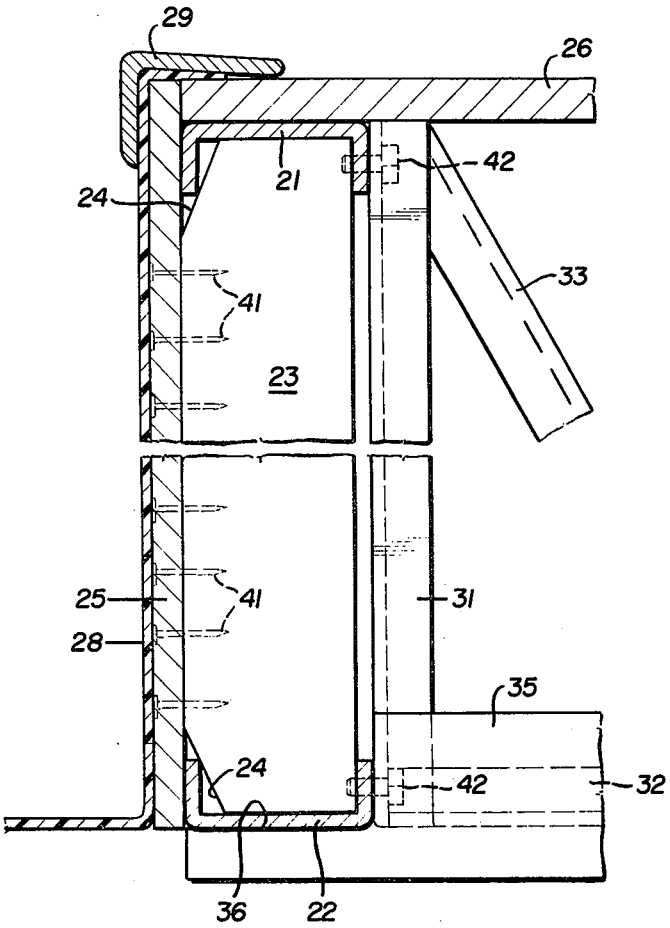
FIG. 6
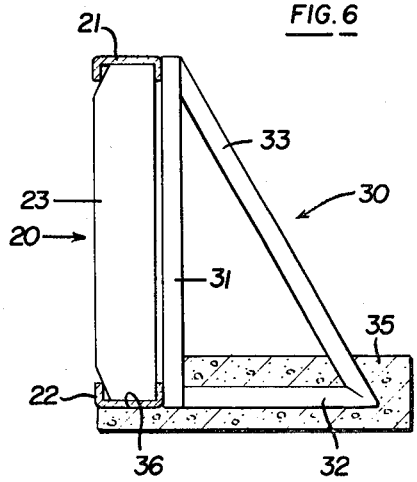
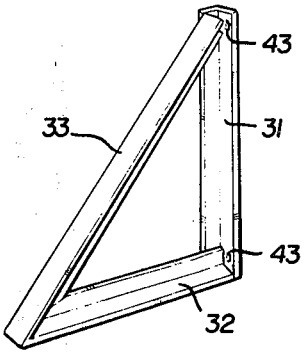
FIG. 7
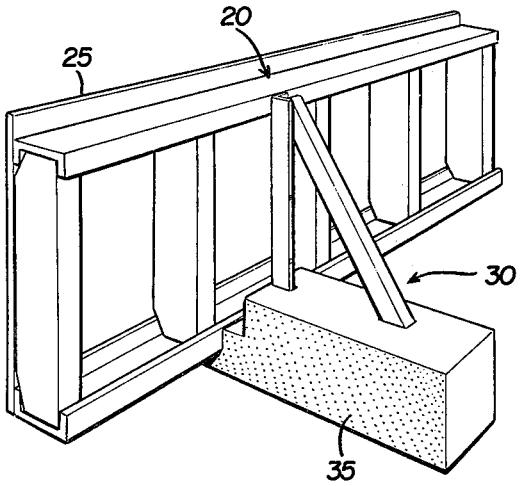
FIG. 8
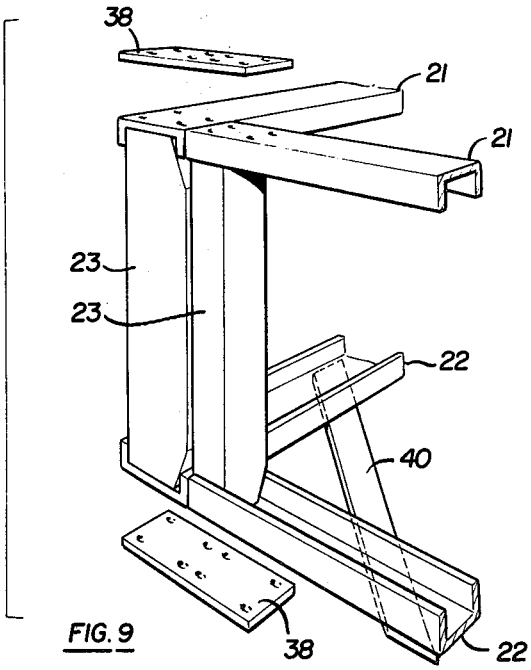
FIG. 9

SWIMMING POOL CONSTRUCTION

BACKGROUND OF THE INVENTION

Below ground swimming pools are typically made by first digging an appropriately sized hole into the ground and thereafter pouring concrete into the hole to form walls and a floor for the pool. Thus, the typical construction involves considerable labor and the handling of considerable quantities of concrete on the job site.

Since the construction of such pools is expensive and time consuming, it would be desirable to have a prefabricated system for forming components of the pool elsewhere and then assemblying them on the job site with minimum labor and with minimum usage of concrete. Thus, the invention herein relates to a prefabricated pool construction which utilizes a minimum number of components and permits rapid and inexpensive assembly of a pool in a below-ground preformed hole.

SUMMARY OF INVENTION

The invention herein contemplates prefabricating walls for a below-ground swimming pool with the walls being formed of a simple studwall-type framework covered by sheet material, so that the walls may be inserted into a below-ground hole to form the enclosure walls of a swimming pool, and wherein the walls and the ground enclosed by the wall may be covered with a thin, water impervious plastic sheet for thereby forming the complete pool. Normally, the pressure of the water against the inner faces of the walls, opposed by the pressure of the earth on the outer faces of the walls, keeps the walls in position. However, upon draining of the water, when necessary, the walls are stabilized and prevented from toppling inwardly by the external pressure of the earth, by means of outwardly extending braces which serve the dual function of acting as footings for the walls.

The construction herein contemplates assemblying at a factory site either a complete wall or a wall section or alternatively, the wood and metal strip components which make up a wall for assembly of these on the job site, and then the movement of the components to the job site for assembly within a pre-dug swimming pool hole, all with minimum labor and with minimum concrete usage. The construction contemplates the usage of the concrete to form footings-braces at either a factory site or on the job, as may be best under the circumstances.

An advantage of the foregoing invention is that with minimum labor, either relatively unskilled help or even a homeowner can rapidly assemble a swimming pool utilizing a minimum of materials and concrete and construct a pool which is sturdy and long lived and yet, can be easily repaired and replaced, i.e., by removal of components, when desired.

A further object of the invention herein is to provide simplified footings for the prefabricated pool wall constructions which footings function to support and position the wall and wall frames and which can be easily inserted or removed as required and particularly, can be formed with minimum and unskilled labor.

These and other objects and advantages of this invention will become apparent upon reading the following description, of which the attached drawings form a part.

DESCRIPTION OF DRAWINGS

FIG. 5 is an enlarged, cross-sectional view taken in the direction of arrows 5—5 of FIG. 1.

FIG. 6 is a view, to a reduced scale, showing the brace construction.

FIG. 7 is a perspective view showing the metal frame portion of a brace.

FIG. 8 is a perspective view to a reduced scale, showing a portion of a wall and a brace in position.

FIG. 9 is a fragmentary, perspective view, showing the corner juncture between two adjacent walls.

DETAILED DESCRIPTION

Figure 1:
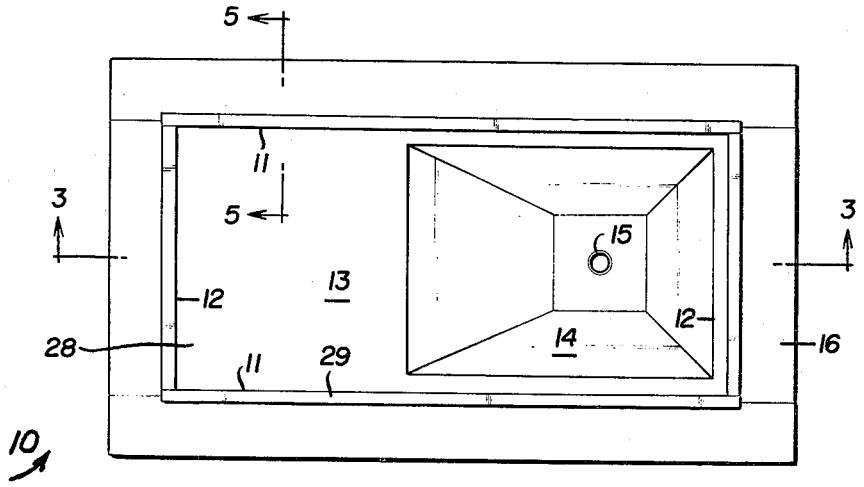
FIG. 1 is a top plan view of a swimming pool constructed in accordance with the invention herein.
Figure 2:
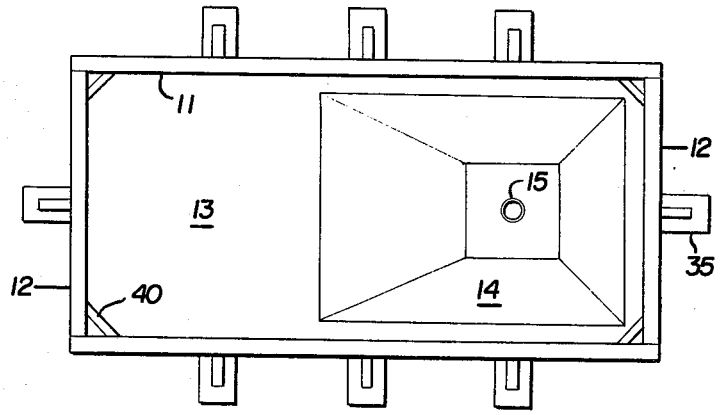
FIG. 2 is a top plan view of the walls and the ground enclosed by the walls in the course of constructing the pool.
Figure 3:
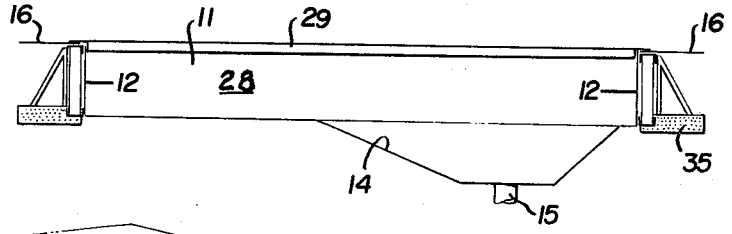
FIG. 3 is an elevational cross-sectional view of the pool and taken in the direction of arrows 3—3 of FIG. 1.

The swimming pool 10, is formed of opposed side walls 11 and end walls 12 which enclose a floor 13 formed by the bottom of a hole dug to receive the walls and generally shaped into a swimming pool size and shape. The ground is dug out at the floor area to a deep diving type depression 14 where a drain 15 is placed and led from the pool area in a conventional plumbing manner. The pool construction, in essence, consists of the four walls which make up the roughly rectangular shaped pool and the ground which makes up the floor. A surrounding deck 16 is arranged around the peripheral upper edges of the walls and upon the ground at grade level.

The walls themselves are each formed of a frame 20 made of an upper channel 21 and a lower channel 22, each formed of metal and respectively arranged for opposing one another, with the channels inter-connected by vertical strips 23, such as conventional 2×4 wood studs, whose upper and lower ends fit into the upper and lower channels respectively. Preferably, one side at each end of the studs is chamfered at 24 or else rabbitted so that their vertical faces are in a common plane with the legs forming the channels.

Relatively stiff plywood sheet material 25 is secured to the frame constructions using nails or screws 41. Preferably the plywood and the wood studs are suitably treated with a preservative to avoid rotting and also, the plywood is thick enough, as for example, ⅝ inch thickness, to resist the expected forces.

Figure 4:
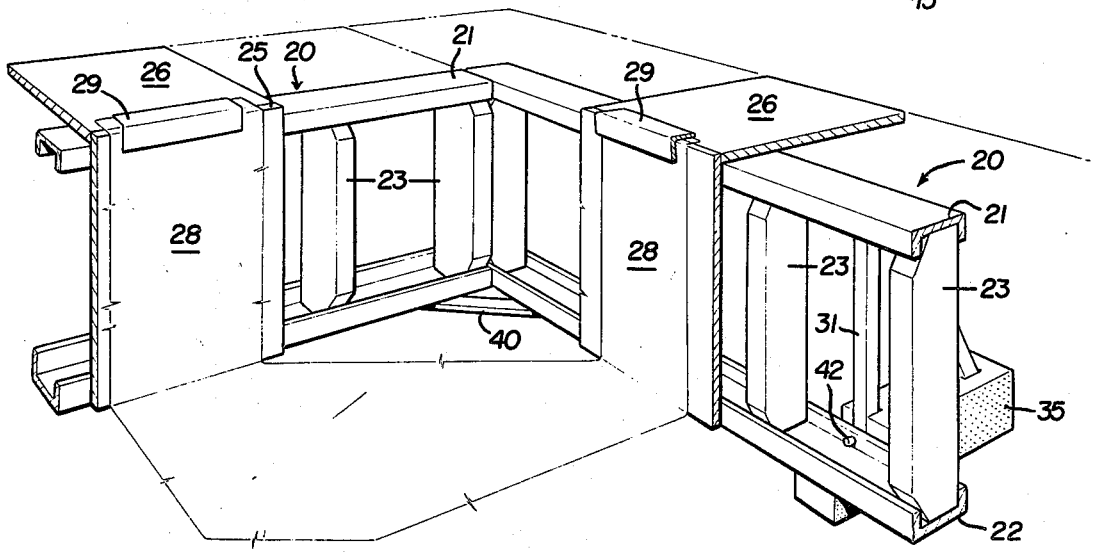
FIG. 4 is a fragmentary view, in perspective, showing portions of a side and end wall.

As shown in FIGS. 4 and 5, the plywood sheet material extends slightly above the upper channel 21 to provide a notch or step for laying in the deck sheeting 26 which may be formed of plywood or alternatively, of numerous separate strips, such as 2×4s or the like, laid one adjacent the other to form a deck.

A large, thin, water impervious plastic sheet, as for example, twenty mil thick vinyl sheeting 28 is laid over the inner surface of the plywood sheet material and the enclosed floor 13 of the pool to form a complete water impervious skin. The sheet may be held in place by turning its upper edge over the top of the walls and then fastening the sheet in place with a continuous coping strip 29 which may be formed of an extruded metal or plastic, or the like.

In order to keep the walls in their vertical or upright positions, a number of braces 30 are provided. These are formed, preferably, in a triangular shape made up of three angle iron strips welded together to form a vertical leg 31, a horizontal leg 32, and an angularly arranged leg 33 which together form a right angle triangle. Thus the vertical leg 31 may be secured as by bolts 42 through apertures 43 therein to the upper and lower channels 21, 22 with the horizontal leg 32 extending outwardly from the wall.

The brace is completed by pouring concrete to form a thin, narrow, low concrete strip 35 encasing the leg 33 and preferably formed with a stepped portion 36 to form a bearing area beneath the lower channels 22 of the walls. The concrete may be poured at the job site after positioning the walls and the braces and providing trenches in the ground for receiving and for forming the concrete or alternatively may be prefabricated at a factory site, so that the brace formed of both the metal and the concrete may be trucked to the pool site for assembly.

As can be seen, the metal-concrete brace configuration functions to keep the walls upright and in position and to prevent the walls from toppling inwardly upon emptying the pool of water because of the weight of the ground or earth upon the horizontal legs of the braces. In addition, the horizontal legs of the braces function as footings to keep the walls properly positioned and level.

The side walls and end walls are connected together at their adjacent vertical edges, by means of upper and lower corner plates 38 and a lower angle plate 40 which are connected, as by screws or appropriate types of nails, to the respective upper and lower channels, as indicated in FIG. 9.

In constructing the pool, first the appropriately sized hole is dug. At this point, the walls which may be completely prefabricated at a factory site may be brought to the job site and simply lowered into the holes and their corners connected together to form the four-sided enclosure. Alternatively, a homeowner or contractor could be provided with prefabricated components to make up the wall, such as the metal channels, studs and plywood, unassembled for assembly at the job site.

Once the walls are in place and the braces are likewise secured in position, it is desirable to appropriately level out the floor enclosed by the walls. This can be done by dumping sand into the hole and smoothing it out to provide a sand base, as for example, two inches thick or so, to form the bottom of the pool. Thereafter, the plastic sheeting is positioned to cover the walls and the ground and the coping strips are applied to fasten the sheeting in place.

At this point, the walls are kept in their upright position by the braces. Back filling of earth as necessary provides the weight upon the horizontal legs of the braces to anchor them and their walls in position.

Thereafter, filling the pool with water provides the force against the inner faces of the walls which counteract the forces of the earth, and water contained within the earth, against the outer faces to thereby keep the walls positioned properly. In essence, the walls merely act as thin, water impervious separators to separate the land from the water and thus, little strength is required from the walls so that they may be made of light-weight construction as shown.

Normally, the water may stay within the pool for years by providing a suitable water filtration system and covering the pool as necessary in those areas where the pool may not be used during winter weather. In the event that the pool is emptied, the walls are prevented from toppling inwardly by the braces. At all times, the braces also function as footings beneath the walls to maintain the walls properly positioned and level, etc.

Having fully described an operative embodiment of this invention, I now claim:

1. In a swimming pool construction including a plurality of upright walls, each wall including horizontal upper and lower strips interconnected by spaced apart vertical strips to form a frame and relatively stiff sheet material secured to one side of each frame, and a number of spaced apart bracings for each upright wall, each bracing including a horizontal leg, a vertical leg and an angular leg, said legs being interconnected in a triangular configuration, each bracing secured to the other side of a frame, the improvement comprising:

a concrete foundation on said other side of said frame, said concrete foundation having an upper surface, said upper surface having upper and lower levels, said lower level extending under and supporting said lower wall frame strip; and said horizontal brace leg being completely embedded in and supported by said concrete foundation.

2. The invention as defined in claim 1 wherein said horizontal brace leg is embedded to the depth of said lower level.

3. The invention as defined in claim 1 wherein said upper and lower strips are U-shaped channels and the ends of the vertical strips are of a reduced size to fit within the U-shaped channels.

* * * * *